US007428832B2

(12) United States Patent
Park

(10) Patent No.: US 7,428,832 B2
(45) Date of Patent: Sep. 30, 2008

(54) DRUM WASHING MACHINE

(75) Inventor: Jong A Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 297 days.

(21) Appl. No.: 11/034,803

(22) Filed: Jan. 14, 2005

(65) Prior Publication Data

US 2006/0005583 A1 Jan. 12, 2006

(30) Foreign Application Priority Data

Jul. 8, 2004 (KR) ..... 10-2004-0053126

(51) Int. Cl.
*D06F 37/08* (2006.01)

(52) U.S. Cl. ..... 68/24; 68/58; 68/140

(58) Field of Classification Search ..... 134/24, 134/25, 58, 140; 68/24, 25, 58, 140
See application file for complete search history.

(56) References Cited

U.S. PATENT DOCUMENTS 1,447,420 A * 3/1923 Kirby ..... 68/25
1,924,521 A * 8/1933 Smith ..... 68/139
2,175,936 A * 10/1939 Zimarik ..... 68/139
2,205,130 A * 6/1940 Belding ..... 68/27
2,279,656 A * 4/1942 Chamberlin et al. ..... 68/16
2,343,102 A * 2/1944 Wesely ..... 38/143
2,344,253 A * 3/1944 Kirby ..... 68/12.01
2,372,769 A * 4/1945 De Remer ..... 68/23.3
2,399,319 A * 4/1946 Bowen et al. ..... 475/318
2,426,078 A * 8/1947 Bassett, Jr. ..... 74/368
2,555,269 A * 5/1951 Chamberlin ..... 68/140
2,615,320 A * 10/1952 Belaieff ..... 68/24
2,760,383 A * 8/1956 De Moss ..... 74/572.4
2,911,810 A * 11/1959 Lantz et al. ..... 68/12.15
2,962,886 A * 12/1960 Johnson ..... 68/18 F
3,022,654 A * 2/1962 Aberle ..... 68/18 F
3,073,668 A * 1/1963 Rothenberger ..... 8/159
3,116,243 A * 12/1963 Khan et al. ..... 34/322
3,172,277 A * 3/1965 Burkland ..... 68/12.16
3,262,569 A * 7/1966 Wade et al. ..... 210/144
3,330,168 A * 7/1967 Kahn ..... 74/572.4

* cited by examiner

*Primary Examiner*—Frankie L Stinson
(74) *Attorney, Agent, or Firm*—Birch, Stewart, Kolasch & Birch, LLP

(57) ABSTRACT

A drum washing machine having improved dehydrating performance is disclosed. The drum washing machine includes a tub with an opened front side, a drum rotatably provided in the tub, and an overflow controller provided in the tub, preventing water from flowing to the front of the tub.

13 Claims, 4 Drawing Sheets

DRUM WASHING MACHINE

This application claims the benefit of Korean Application No. P2004-53126, filed on Jul. 8, 2004, which is hereby incorporated by reference as if fully set forth herein.

BACKGROUND OF THE INVENTION

1. Field of the Invention

The present invention relates to a washing machine, and more particularly to, a gasket and a drum washing machine using the same that prevents washing water from being leaked out and absorbs vibration.

2. Discussion of the Related Art

Generally, a washing machine is configured to contain water and detergents in a lower portion inside a tub and to perform washing, rinsing and dehydrating functions by rotating a drum provided inside the tub after putting the laundry into the drum.

The washing machine is to remove dirt on the laundry using proper detergents and a mechanical force.

Particularly, a drum washing machine is to remove dirt on the laundry as the laundry is rotated by a driving force of a motor after detergents, washing water and the laundry are put into a drum. The drum washing machine has advantages in some respects. In other words, in the drum washing machine, twist or damage of the laundry little occurs, a small amount of washing water is required, and beating and rubbing effects can be obtained.

Referring to FIG. 1, a related art drum washing machine includes a cabinet 10 constituting appearance, having an opening formed at the front to put or take the laundry into or out, a door 11 connected to the front of the cabinet to open and close the opening, a tub 20 provided in the cabinet, having a round shaped inlet connected with the opening of the cabinet 10, and a drum 30 rotatably provided in the tub 20, having a plurality of through holes at sides and an opened inlet at the front.

A laundry drop for putting the laundry into the drum 30 is formed at the opening of the cabinet 10, the inlet of the tub 20 and the inlet of the drum 30.

A lifter 31 is provided at an inner side of the drum 30 to lift the laundry at a certain height. If the drum 30 is rotated, the laundry is lifted to the upper portion inside the drum by the lifter 31. The laundry is then dropped by gravity. The washing operation of the laundry is performed by repeatedly performing the above operations.

A rotational means such as a motor 40 rotating the drum is provided at the rear of the tub 20. The drum 30 is rotated in forward and reverse directions by means of forward and reverse rotations of the motor.

A drainage 50 is provided at the lower portion of the tub 20 to eject washing water in the tub 20 to the outside of the cabinet 10.

Furthermore, a gasket 60 is provided between the opening of the cabinet 10 and the inlet of the tub 20. The gasket 60 damps impact caused by rotation of the drum 30 and prevents the washing water from being leaked out when the drum 30 is rotated in a state that the door 11 is closed.

However, the aforementioned drum washing machine has a problem. That is, if the drum 30 is rotated at high speed during a dehydrating stroke, dehydrated water overflows into the front of the tub 20 and enters the drum 30 again. For this reason, the laundry is wet again and dehydrating performance is deteriorated.

SUMMARY OF THE INVENTION

Accordingly, the present invention is directed to a drum washing machine that substantially obviates one or more problems due to limitations and disadvantages of the related art.

An object of the present invention is to provide a drum washing machine having improved dehydrating performance.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum washing machine includes a tub with an opened front side, a drum rotatably provided in the tub, and an overflow controller provided in the tub, preventing water from flowing to the front of the tub.

The overflow controller includes a flow controlling projection projected from an inner circumference of the tub at a predetermined height to prevent the water in the tub from flowing to the opened front side of the tub.

The flow controlling projection is provided at a front portion of the tub.

The flow controlling projection is formed in an inner circumference at the lower portion of the tub at a predetermined length along a circumferential direction.

Preferably, the flow controlling projection has a ring shape surrounding the inner circumference of the tub in a circumferential direction.

The flow controlling projection formed in the inner circumference at the lower portion of the tub is projected higher than that formed in an inner circumference at the upper portion of the tub.

The flow controlling projection is projected toward a central shaft of the tub and has a flow prevention wall vertical to the central shaft of the tub.

The front portion of the tub has an inner diameter tapered gradually toward the front end of the tub.

The flow controlling projection is projected in a direction vertical to the inner circumference of the front portion of the tub or in parallel to the central shaft of the tub.

The drum washing machine further includes a rotation flow controller provided in the inner circumference of the tub to prevent the water in the tub from being rotated.

The rotation flow controller includes at least one rotation prevention rib or a plurality of rotation prevention ribs projected from the inner circumference of the tub, having a rotation prevention wall vertical to the circumferential direction.

The rotation prevention rib is projected toward the central shaft of the tub.

The rotation prevention ribs are spaced apart from one another in a circumferential direction at the inner circumference of the tub.

The rotation prevention rib is formed at a front portion of the tub.

The front portion of the tub has a diameter tapered gradually toward the front end of the tub.

The rotation flow controller is formed in a single body with the overflow controller.

In the drum washing machine of present invention as described above, since water dehydrated from the laundry during a dehydrating stroke is prevented from flowing to the drum again, it is possible to prevent dehydrating performance from being deteriorated.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

An example of a drum washing machine according to the present invention will be described with reference to FIG. 2.

Figure 1:
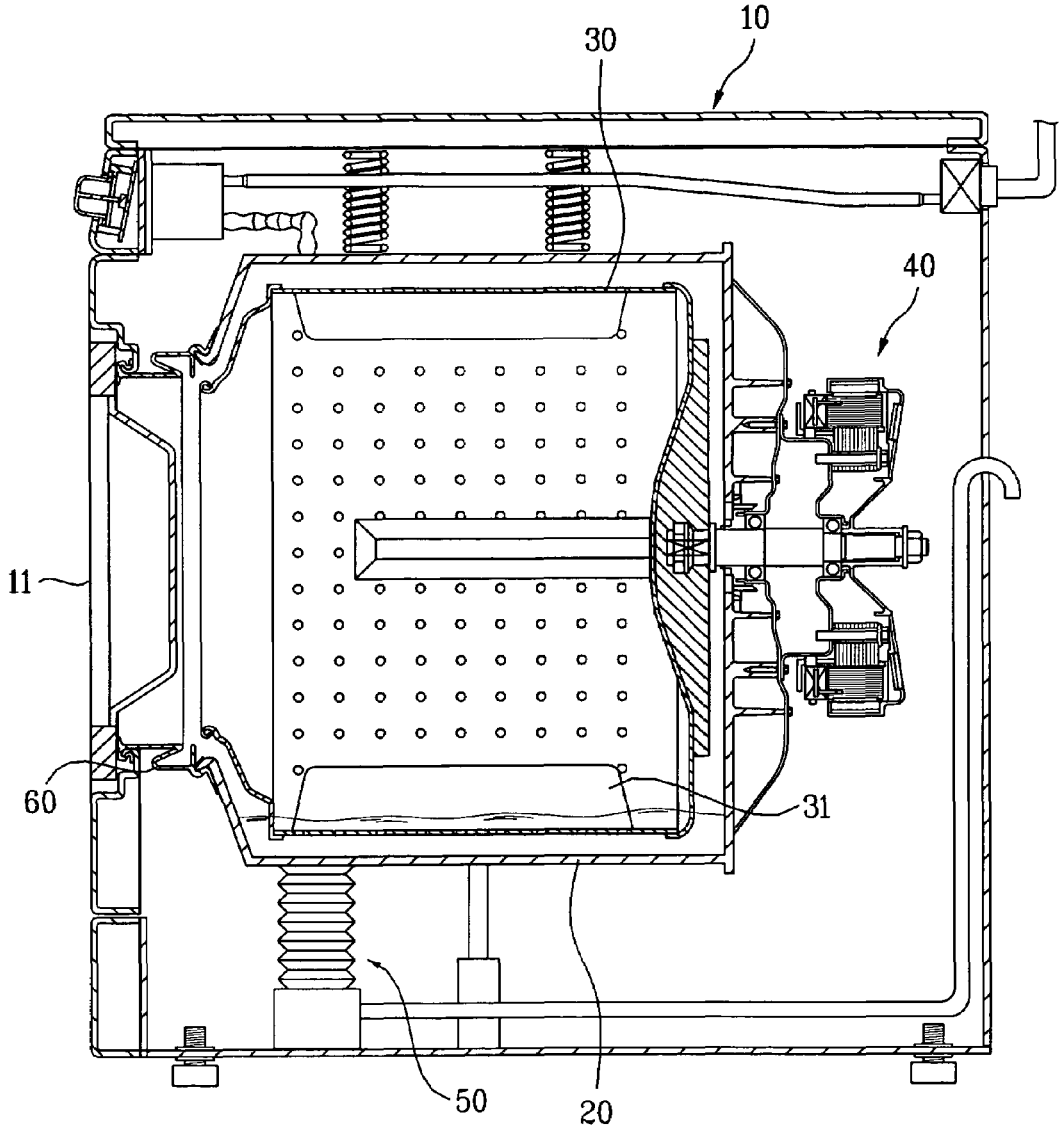
FIG. 1 is a sectional view illustrating a related art drum washing machine.
Figure 2:
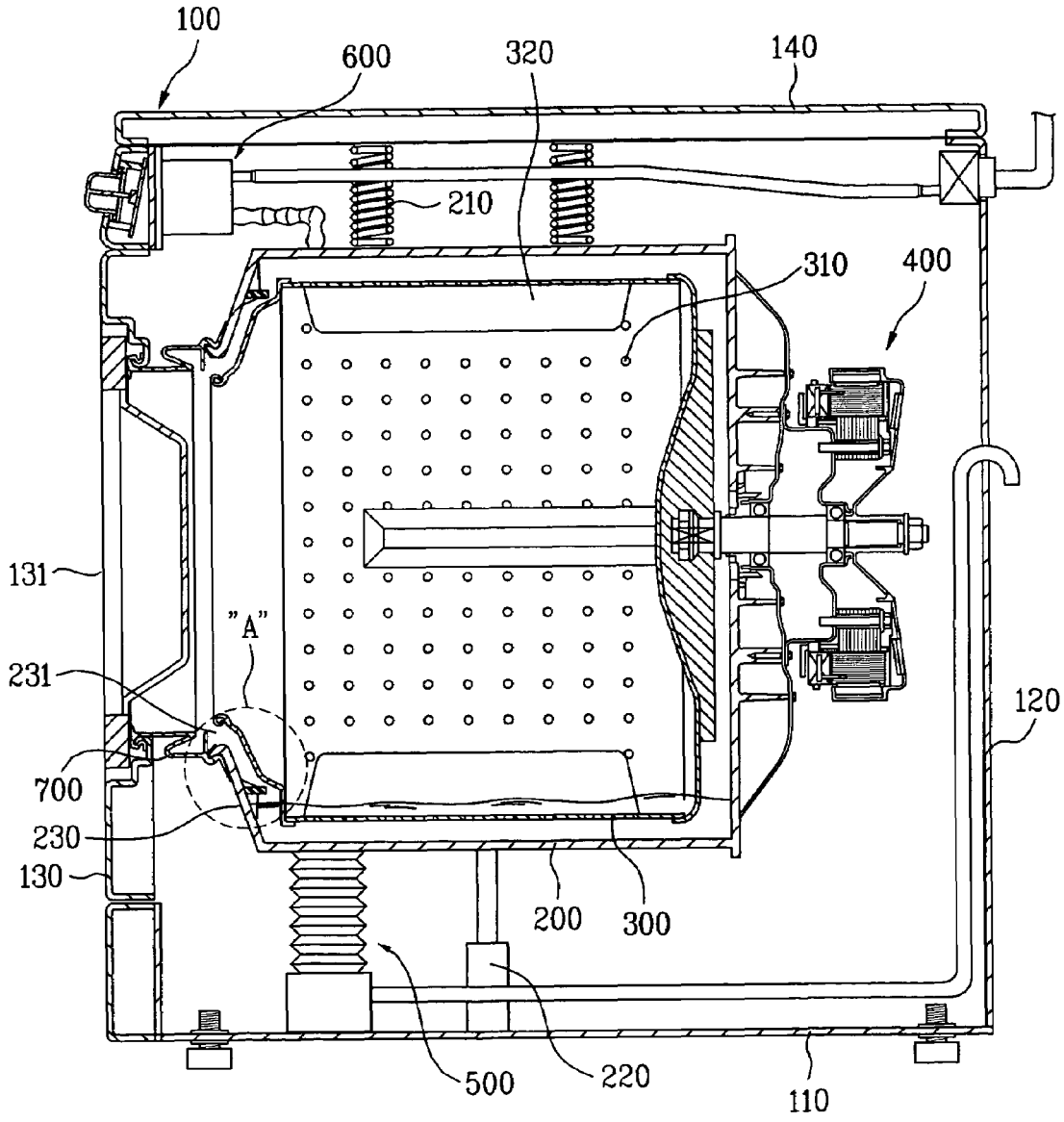
FIG. 2 is a sectional view illustrating a drum washing machine according to one embodiment of the present invention.

FIG. 2 is a sectional view illustrating a drum washing machine according to one embodiment of the present invention.

As shown in FIG. 2, a drum washing machine of the present invention includes a cabinet 100 constituting appearance, a tub 200 provided inside the cabinet, a drum 300 rotatably provided at the inner side of the tub 200, and a rotational means 400 rotating the drum 300.

The cabinet 100 includes a base plate 110 provided at the lower portion, a pair of side plates (not shown) provided at both sides of the base plate 110, a rear plate 120 provided at the rear of the base plate 110 and the side plates, a front plate 130 provided at the front of the base plate and the side plates, and a top plate 140 provided at the top of the side plates, the rear plate and the front plate.

An opening (not shown) is provided at the center of the front plate 130 to put and take the laundry into and out. The opening is provided with a door 131. A control panel (not shown) is provided at the upper portion of the front plate 130 to control the operation of the drum washing machine.

The tub 200 has a cylindrical shape with an opened front side. The tub 200 is supported by an elastic means 210, such as a spring, and a damper 220 in the cabinet 100 to damp vibration generated when the drum washing machine is operated.

The drum 300 has a cylindrical shape with a plurality of through holes 310 to pass washing water therethrough. The drum 300 is provided with a lifter 320 at the inner wall to lift the washing water at a certain height. If the drum 300 is rotated, the laundry is lifted to the upper portion inside the drum by the lifter 320. The laundry is then dropped by gravity. The washing operation of the laundry is performed by repeatedly performing the above operations.

The front side of the drum 300 is opened, and the laundry is put into or taken out of the drum 300 through the opened front side.

The rotational means 400 is comprised of an induction motor or a BLDC motor provided at the rear of the tub 200. A rotational shaft of the motor is connected with the center at the rear of the drum 300 to rotate the drum in forward and reverse directions.

A drainage 500 is provided at the lower portion of the tub 200 to drain the washing water, and a water supply system 600 is provided at the upper portion of the tub 200 to supply the washing water.

A gasket 700 is provided between the front plate 130 and the tub 200. The gasket 700 serves as a packing that absorbs impact given to the front plate 130 of the cabinet 100 by vibration generated during rotation of the drum 300 and prevents the washing water from being leaked out.

The drum washing machine of the present invention further includes an overflow controller provided in the tub 200 to prevent the water from flowing to the front of the tub 200.

Hereinafter, the overflow controller will be described with reference to FIG. 2 to FIG. 4.

Figure 3:
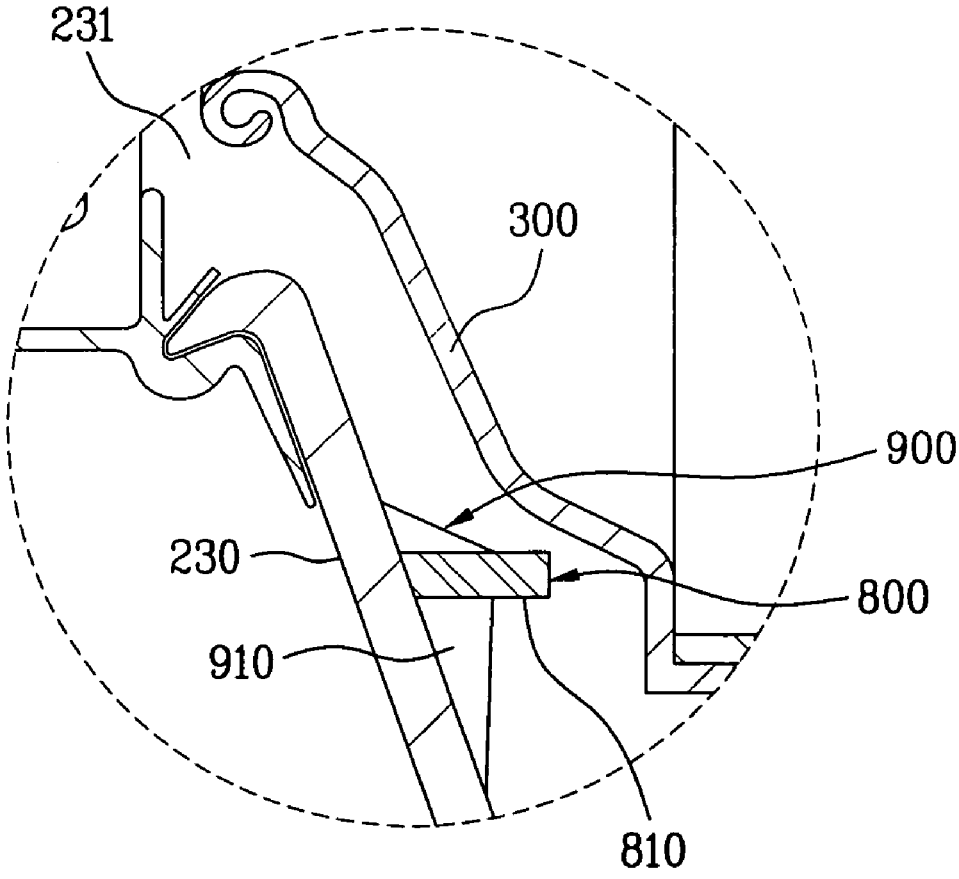
FIG. 3 is an enlarged view of a portion "A" of FIG. 2.
Figure 4:
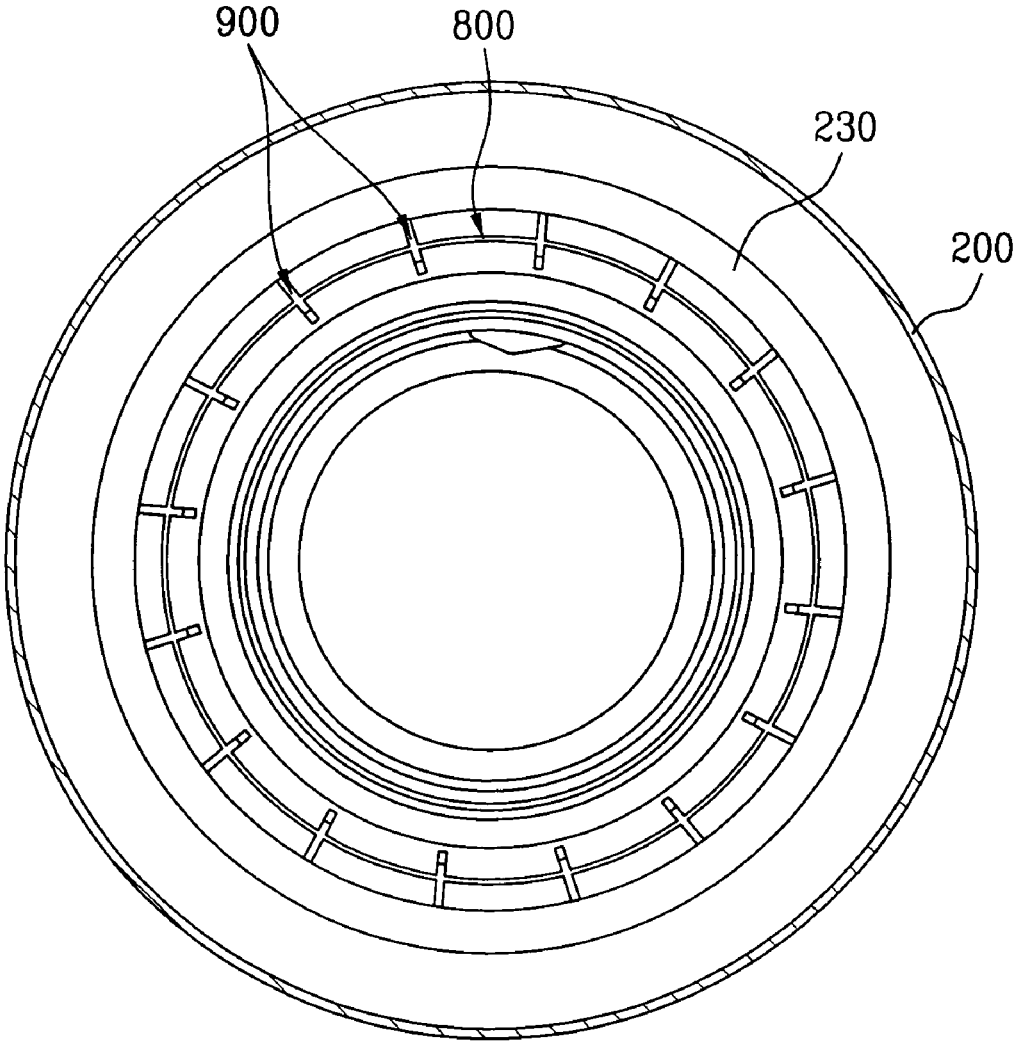
FIG. 4 is a sectional view of a tub viewed from the rear after cutting the tub provided in a drum washing machine according to the present invention in a vertical direction against a shaft.

Referring to FIG. 2 to FIG. 4, the overflow controller includes a flow controlling projection 800 projected from the inner circumference of the tub 200 at a predetermined height to stop the water inside the tub 200 from flowing toward the opened front side of the tub 200.

In more detail, the flow controlling projection 800 is provided at a front portion 230 of the tub 200 to prevent the water from being leaked into a clearance 231 formed between the front end of the drum 300 and the front end of the tub 200.

The front portion 230 of the tub 200 has an inner diameter reduced gradually toward the front. In more detail, the front portion 230 of the tub is formed in such a manner that its inner and outer sides are tapered toward a central shaft of the tub 200 in a front direction.

The flow controlling projection 800 has a ring shape to surround the inner circumference of the front portion 230 in a circumferential direction.

The flow controlling projection 800 may be formed only in the inner circumference corresponding to the lower portion of the front portion 230 at a predetermined length along the circumferential direction. This is because that the washing water ejected through the through hole 310 of the drum is gathered in a lower space of the tub 200 by gravity.

However, since the washing water may be leaked into the front of the tub 200 along the inner circumference at the upper portion of the tub 200 in case that the drum 300 is rotated at high speed during a dehydrating stroke, it is preferable that the flow controlling projection 800 has a ring shape.

Meanwhile, the flow controlling projection formed in the inner circumference at the lower portion of the tub 200 may be projected higher than that formed in the inner circumference at the upper portion of the tub 200.

The flow controlling projection 800 has a flow prevention wall 810 stopping flow of the washing water. To this end, the flow controlling projection 800 is projected toward the central shaft of the tub 200 in a vertical direction relative to the central shaft of the tub 200. Alternatively, the flow controlling projection 800 is projected in a vertical direction relative to the inner surface of the front portion 230 of the tub 200.

As shown in FIG. 2 to FIG. 4, the flow controlling projection 800 may be projected in parallel to the central shaft of the tub 200.

Furthermore, the flow controlling projection 800 may be made of a flexible material considering that it may collides against the drum during rotation of the drum 300.

Meanwhile, if the drum 300 is rotated at high speed during a dehydrating stroke, the water inside the tub 200 is also rotated by the drum 300. In this case, since the amount of the ejected water is reduced by the drainage 500, dehydrating performance is remarkably deteriorated. Therefore, it is preferable that the drum washing machine of the present invention further includes a rotation flow controller provided at the inner circumference of the tub 200 to prevent the water in the tub 200 from being rotated.

The rotation flow controller includes at least one rotation prevention rib 900 projected from the inner circumference of the tub 200.

In more detail, the front portion 230 of the tub 200 is provided with a plurality of rotation prevention ribs 900 spaced apart from one another at predetermined intervals in a circumferential direction.

The respective rotation prevention rib 900 includes a rotation prevention wall 910 vertical to a circumferential direction, i.e., a rotational direction of the water. The rotation prevention rib 900 is formed in a single body with the flow controlling projection 800 and prevents the water inside the tub 200 from being rotated by the drum 300.

The operation of the aforementioned drum washing machine according to the present invention will be described as follows.

First, after the laundry such as clothes is put into the drum 300, the door 131 is closed and the drum washing machine is operated.

Then, the washing water is supplied into the tub 200 by the water supply system 600, and the laundry in the drum 300 is wet by the washing water.

As the drum 300 is rotated, a washing stroke is performed. If the washing stroke ends, washing water is newly supplied into the tub 200 through the water supply system 600 so that a rinsing stroke of the laundry is performed.

If the rinsing stroke ends, a dehydrating stroke is performed.

If the drum 300 is rotated at high speed to perform the dehydrating stroke, the water of the laundry is removed from the laundry by a centrifugal force and is ejected to the tub 200 through the through hole 310 of the drum. The water is then outwardly drained through the drainage 500.

At this time, if the drum 300 is rotated at high speed, air flow toward the front of the tub 200 occurs in the tub 200. The water in the tub 200 flows toward the front of the tub 200 by means of such air flow.

The ring shaped flow controlling projection 800 formed at the tapered front portion 230 of the tub 200 along the circumferential direction stops the water flowing toward the opened front side of the tub 200.

The water stopped by the flow controlling projection 800 flows to the lower portion of the tub 200 and is drained through the drainage 500.

Furthermore, if the drum 300 is rotated at high speed, the water in the tub 200 is rotated at high speed along with the drum 300 along the inner circumference of the tub 200 due to the rotational force of the drum 300.

The rotation prevention ribs 900 formed along the circumferential direction at the inner side of the tub 200 stop rotation of the water flowing in the tub 200 by means of the rotation prevention wall to reduce flow speed.

Thus, the water in the tub 200 flows to the lower portion of the tub 200 by gravity and then is drained through the drainage 500.

The aforementioned drum washing machine has the following advantages.

Since the overflow controller prevents the water in the tub from overflowing to the drum during the dehydrating stroke, dehydrating performance is improved.

In addition, since the overflow controller prevents the water in the tub from overflowing to the door during the dehydrating stroke, the laundry is prevented from being wet when it is taken out of the drum after the dehydrating stroke ends.

Finally, since the rotation flow controller prevents the water in the tub from being rotated along with the drum during the dehydrating stroke, drainage performance and dehydrating performance can be improved.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum washing machine comprising:

a cabinet having a side wall and a door opening in the side wall;

a tub with an opened front side facing the door opening;

a drum rotatably provided in the tub; and an overflow controller provided in the tub, preventing water in the tub from flowing to the front of the tub during a dewatering spin of the drum, wherein the overflow controller includes a flow controlling projection projected from an inner circumference of the tub at a predetermined height to prevent the water in the tub from flowing to the opened front side of the tub, wherein the flow controlling projection is provided at a front portion of the tub, wherein the flow controlling projection has a ring shape surrounding the inner circumference of the tub in a circumferential direction, and wherein the flow controlling projection formed in the inner circumference at the lower portion of the tub is projected higher than that formed in an inner circumference at the upper portion of the tub.

2. The drum washing machine of claim 1, wherein the flow controlling projection is formed in an inner circumference at the lower portion of the tub at a predetermined length along a circumferential direction.

3. The drum washing machine of claim 1, wherein the front portion of the tub has an inner diameter tapered gradually toward the front end of the tub.

4. The drum washing machine of claim 3, wherein the flow controlling projection is projected in a direction vertical to the inner circumference of the front portion of the tub.

5. The drum washing machine of claim 3, wherein the flow controlling projection is projected in parallel to the central shaft of the tub.

6. The drum washing machine of claim 1, further comprising a rotation flow controller provided in the inner circumference of the tub to prevent the water in the tub from being rotated.

7. The drum washing machine of claim 6, wherein the rotation flow controller includes at least one rotation prevention rib or a plurality of rotation prevention ribs projected from the inner circumference of the tub, having a rotation prevention wall vertical to the circumferential direction.

8. The drum washing machine of claim 7, wherein the rotation prevention rib is projected toward the central shaft of the tub.

9. The drum washing machine of claim 7, wherein the rotation prevention ribs are spaced apart from one another in a circumferential direction at the inner circumference of the tub.

10. The drum washing machine of claim 7, wherein the rotation prevention rib is formed at a front portion of the tub.

11. The drum washing machine of claim 10, wherein the front portion of the tub has a diameter tapered gradually toward the front end of the tub.

12. A drum washing machine comprising:

a cabinet having a side wall and a door opening in the side wall;

a tub with an opened front side facing the door opening;

a drum rotatably provided in the tub; and an overflow controller provided in the tub, preventing water in the tub from flowing to the front of the tub during a dewatering spin of the drum, wherein the overflow controller includes a flow controlling projection projected from an inner circumference of the tub at a predetermined height to prevent the water in the tub from flowing to the opened front side of the tub, wherein the flow controlling projection is provided at a front portion of the tub, and wherein the flow controlling projection is projected toward a central shaft of the tub and has a flow prevention wall vertical to the central shaft of the tub.

13. A drum washing machine comprising:

a cabinet having a side wall and a door opening in the side wall;

a tub with an opened front side facing the door opening;

a drum rotatably provided in the tub;

an overflow controller provided in the tub, preventing water in the tub from flowing to the front of the tub during a dewatering spin of the drum; and a rotation flow controller provided in the inner circumference of the tub to prevent the water in the tub from being rotated, wherein the rotation flow controller is formed in a single body with the overflow controller.

* * * * *